US009091260B2

(12) United States Patent
Chang

(10) Patent No.: US 9,091,260 B2
(45) Date of Patent: Jul. 28, 2015

(54) MINIATURE PUMP

(71) Applicant: KOGE ELECTRONICS CO., LTD, New Taipei (TW)

(72) Inventor: Kun-Lin Chang, New Taipei (TW)

(73) Assignee: KOGE ELECTRONICS CO., LTD, New Taipei (TW)

( * ) Notice: Subject to any disclaimer, the term of this patent is extended or adjusted under 35 U.S.C. 154(b) by 254 days.

(21) Appl. No.: 13/684,952

(22) Filed: Nov. 26, 2012

(65) Prior Publication Data

US 2013/0136637 A1 May 30, 2013

(30) Foreign Application Priority Data

Nov. 24, 2011 (TW) ..... 100222267 U
Mar. 19, 2012 (TW) ..... 101204925 U

(51) Int. Cl.
*F04B 41/00* (2006.01)
*F04B 45/04* (2006.01)

(52) U.S. Cl.
CPC ..... *F04B 41/00* (2013.01); *F04B 45/043* (2013.01)

(58) Field of Classification Search
CPC ..... F04B 1/00; F04B 45/043; F04B 43/0063; F04B 43/02
USPC ..... 417/269, 571; 137/846, 855
See application file for complete search history.

(56) References Cited

U.S. PATENT DOCUMENTS 4,153,391 A * 5/1979 Hartley ..... 417/269

FOREIGN PATENT DOCUMENTS

GB 1221253 A * 2/1971 ..... F01L 13/08

* cited by examiner

*Primary Examiner* — Charles Freay
*Assistant Examiner* — Philip Stimpert
(74) *Attorney, Agent, or Firm* — Moser Taboada

(57) ABSTRACT

A miniature pump includes a driving unit and an airflow control unit, which includes a bladder supporter, a compression unit, a valve base and an output valve. The compression unit has multiple intake valves and multiple bladders, each intake valve covers the corresponding intake through hole, each intake through hole is surrounded by a circular wall, wherein the circular wall is disposed on a bottom surface of the corresponding intake valve or a top surface of the corresponding bladder supporter. The valve base is arranged over the compression unit, and the valve base has multiple output through holes aligned with the bladders respectively. When the bladder is compressed, air inside the bladder is output via the output through hole and the output valve. When the bladder is decompressed, external air is introduced into the bladder via the intake through hole and the intake valve.

13 Claims, 11 Drawing Sheets

MINIATURE PUMP

RELATED APPLICATIONS

The present application is based on, and claims priority from, Taiwan Application Serial Number 101204925, filed on Mar. 19, 2012 and Taiwan Application Serial Number 100222267, filed on Nov. 24, 2011, the disclosures of both which are hereby incorporated by reference herein in its entirety.

BACKGROUND

1. Field of Invention

The present invention relates to a miniature pump.

2. Description of Related Art

A miniature pump is a smaller version of a normal pump. Because the pump size is shrunk, the motor unit is also a low power one. Thus, the pump efficiency depends on its valve unit and compression unit design.

FIG. 1 illustrates a cross-sectional view of a conventional miniature pump 100. A basic operation mechanism of the miniature pump 100 is to compress and decompress the bladders to inputs and outputs airflows. In particular, when the bladder 104 is compressed, airflow is directed along the direction 108 via the output through hole 107, the output valve 109 and finally output from an air outlet 110. When the bladder 104 is decompressed, airflow is directed along the directions (106*a*, 106*b*) via the intake through hole 103 and the intake valve 104*a* and finally introduced into the bladder 104. Repeated compressing and decompressing the bladder 104 enable the miniature pump 100 to continue airflow output. The miniature pump 100 is often equipped with multiple bladders 104, which are sequentially compressed and decompressed, so as to output a smooth airflow.

The bladder supporter 102 of the miniature pump 102 is equipped with a convex block 102*a* at a side adjacent to the intake through hole 103 to control airflow and reduce air pressure, but the intake valve 104*a* is not reliable and malfunctions after a period of usage. In addition, the convex block 102*a* has a thin thickness of about 0.2 mm, which cannot be reliably manufactured. Due to the foregoing shortcomings of a conventional miniature pump, more efforts are thus needed to enhance the miniature pump design.

SUMMARY

It is therefore an objective of the present invention to provide an improved miniature pump.

In accordance with the foregoing and other objectives of the present invention, a miniature pump includes a driving unit and an airflow control unit. The airflow control unit is driven by the driving unit to force fluid to be input or output through the airflow control unit, wherein the airflow control unit includes a bladder supporter, a compression unit, a valve base and an output valve. The bladder supporter has a plurality of intake through holes. The compression unit has a plurality of intake valves and a plurality of bladders, each intake valve covers the corresponding intake through hole, each intake through hole is surrounded by a circular wall, wherein the circular wall is disposed on a bottom surface of the corresponding intake valve or a top surface of the corresponding bladder supporter. The valve base is arranged over the compression unit, and the valve base has a plurality of output through holes aligned with the bladders respectively. The output valve covers the output through holes. When the bladder is compressed, air inside the bladder is output via the output through hole and the output valve. When the bladder is decompressed, external air is introduced into the bladder via the intake through hole and the intake valve.

In another embodiment disclosed herein, the valve base has a plurality of bladder sections aligned with the bladders respectively, each bladder section has an isolation wall around thereof, and the any adjacent two isolation walls defines an air channel therebetween.

In another embodiment disclosed herein, the valve base further includes at least one air chamber, and each air chamber is connected with the corresponding air channel.

In another embodiment disclosed herein, the miniature pump further includes a top cover located over the valve base, the top cover has a central air outlet, and all the air channels are connected to a central area of the valve base, which is aligned with the central air outlet.

In another embodiment disclosed herein, the bladder supporter has a plurality of receiving bores, and each receiving bore accommodates the corresponding bladder.

In another embodiment disclosed herein, the valve base has a concave passage on a bottom surface thereof, the concave passage is interconnected between the intake valve and the bladder.

In another embodiment disclosed herein, the driving unit comprises a motor and a compression vane, the compression vane is coupled with a rotation rod of the motor.

In another embodiment disclosed herein, the compression vane has a plurality of connection slots, each connection slot is fastened to a bottom end of the bladder.

In another embodiment disclosed herein, the compression unit includes a flat plate section on which the intake valves are located.

In accordance with the foregoing and other objectives of the present invention, another miniature pump includes a driving unit and an airflow control unit. The airflow control unit is driven by the driving unit to force fluid to be input or output through the airflow control unit, wherein the airflow control unit includes a bladder supporter, a compression unit, a valve base and an output valve. The bladder supporter has a plurality of intake through holes. The compression unit has a plurality of intake valves and a plurality of bladders, and each intake valve covers the corresponding intake through hole. The valve base is disposed over the compression unit, and the valve base has a plurality of output through holes aligned with the bladders respectively. The output valve covers the output through holes, and each output through hole is surrounded by a circular wall, wherein the circular wall is disposed on a bottom surface of the output valve or a top surface of the valve base. When the bladder is compressed, air inside the bladder is output via the output through hole and the output valve. When the bladder is decompressed, external air is introduced into the bladder via the intake through hole and the intake valve.

In another embodiment disclosed herein, the valve base has a plurality of bladder sections aligned with the bladders respectively, and the circular wall surrounds along a complete rim of each bladder section.

In another embodiment disclosed herein, the valve base has a plurality of bladder sections aligned with the bladders respectively, each bladder section has an isolation wall around thereof, and the any adjacent two isolation walls defines an air channel therebetween.

In another embodiment disclosed herein, the valve base further includes at least one air chamber, and each air chamber is connected with the corresponding air channel.

In another embodiment disclosed herein, the miniature pump further includes a top cover located over the valve base, the top cover has a central air outlet, and all the air channels are connected to a central area of the valve base, which is aligned with the central air outlet.

In another embodiment disclosed herein, the bladder supporter has a plurality of receiving bores, and each receiving bore accommodates the corresponding bladder.

In another embodiment disclosed herein, the valve base has a concave passage on a bottom surface thereof, the concave passage is interconnected between the intake valve and the bladder.

In another embodiment disclosed herein, the driving unit comprises a motor and a compression vane, the compression vane is coupled with a rotation rod of the motor.

In another embodiment disclosed herein, the compression vane has a plurality of connection slots, each connection slot is fastened to a bottom end of the bladder.

In another embodiment disclosed herein, the compression unit includes a flat plate section on which the intake valves are located.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
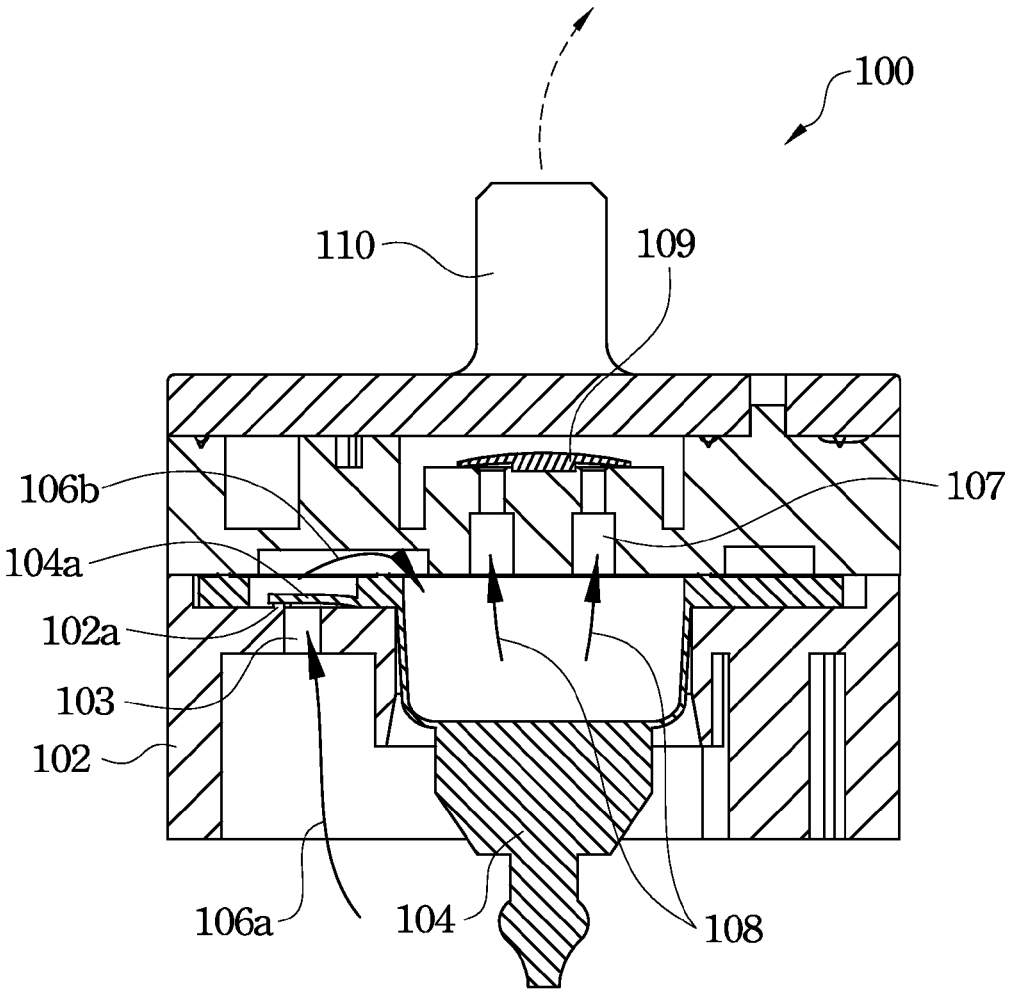
Fig. 1 (Prior Art)
FIG. 1 illustrates a cross-sectional view of a conventional miniature pump.

Reference will now be made in detail to the present preferred embodiments of the invention, examples of which are illustrated in the accompanying drawings. Wherever possible, the same reference numbers are used in the drawings and the description to refer to the same or like parts.

Figure 2:
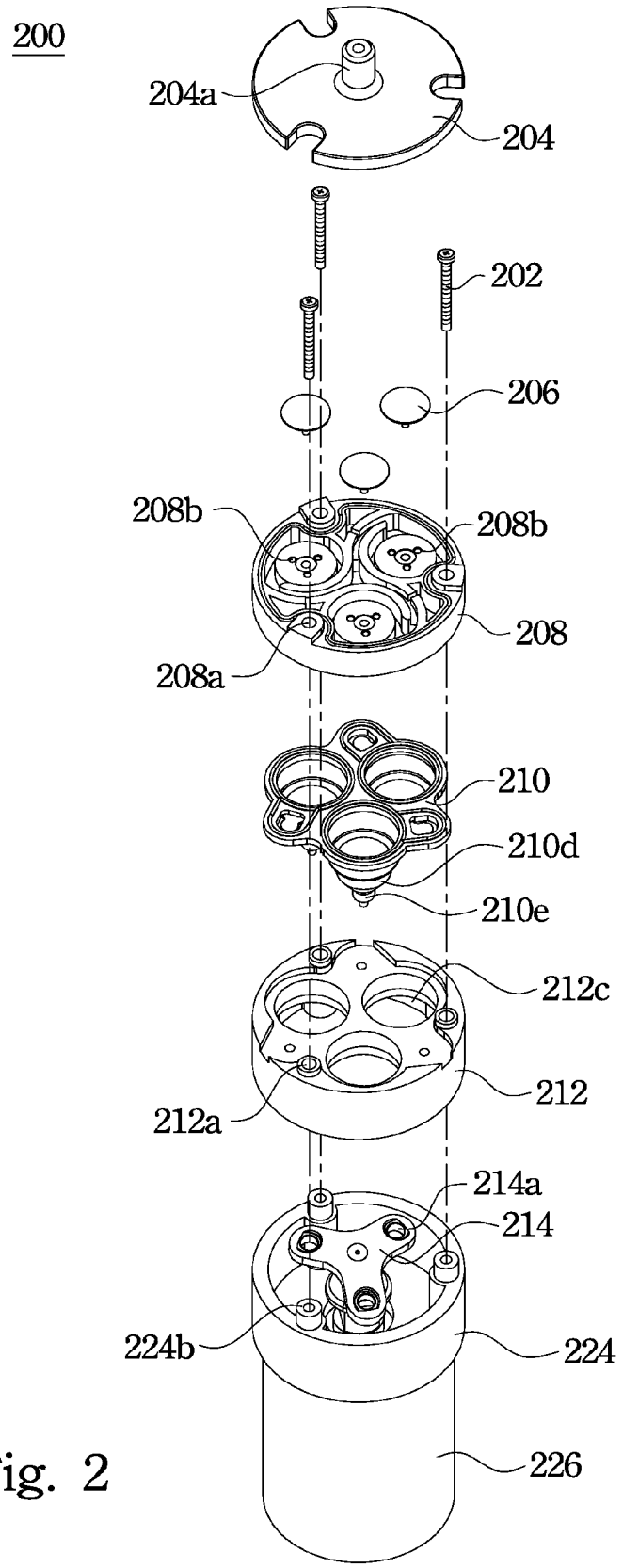
FIG. 2 illustrates an exploded view of a miniature pump according to a first embodiment of this invention (in a top view)

FIG. 2 illustrates an exploded view of a miniature pump 200 according to a first embodiment of this invention (in a top view). The miniature pump 200 basically includes a driving unit and an airflow control unit, the airflow control unit is driven by the driving unit to force the fluid to be input or output through the airflow control unit so as to execute the function of the miniature pump.

The driving unit basically includes a motor 226, a pump holder 224 and a compression vane 214. The compression vane 214 is secured to a rotation rod of the motor 226 such that the motor 226 is able to drive the compression vane 214 to execute its function.

The airflow control unit basically includes a top cover 204, a valve base 208, a compression unit 210, a bladder supporter 212 and a motor 226. The bladder supporter 212 has multiple receiving bores 212*c* for multiple bladders 210*d* of the compression unit 210 to be accommodated within. The bladder number may be varied according to the actual needs. The receiving bore number of the bladder supporter 212 is varied according to the bladder number. After the compression unit 210 is assembled into the bladder supporter 212, the valve base 208 is mounted over the bladder supporter 212 and the compression unit 210. Then, multiple output valves 206 are mounted on the output through holes 208*b* respectively. Each output valve 206 may cover one or multiple output through holes 208*b* according to the actual needs. The top cover 204 is mounted over the valve base 208 to sandwich the output valve 206 between the top cover 204 and the valve base 208. Finally, multiple bolts 202 are used to insert through holes 208*a* of the valve base 208, holes 212*a* of the bladder supporter 212 and holes 224*b* of the pump holder 224 to secure all these components.

The compression vane 214 has multiple connection slots 214*a* at its end portions. Each connection slot 214*a* is fastened to a corresponding bottom end 210*e* of the bladder 210*d*. When the motor 226 drives the compression vane 214 to move, the bladders 210*d* are sequentially compressed and decompressed by the compression vane 214 to execute the basic functions of the miniature pump.

Figure 3:
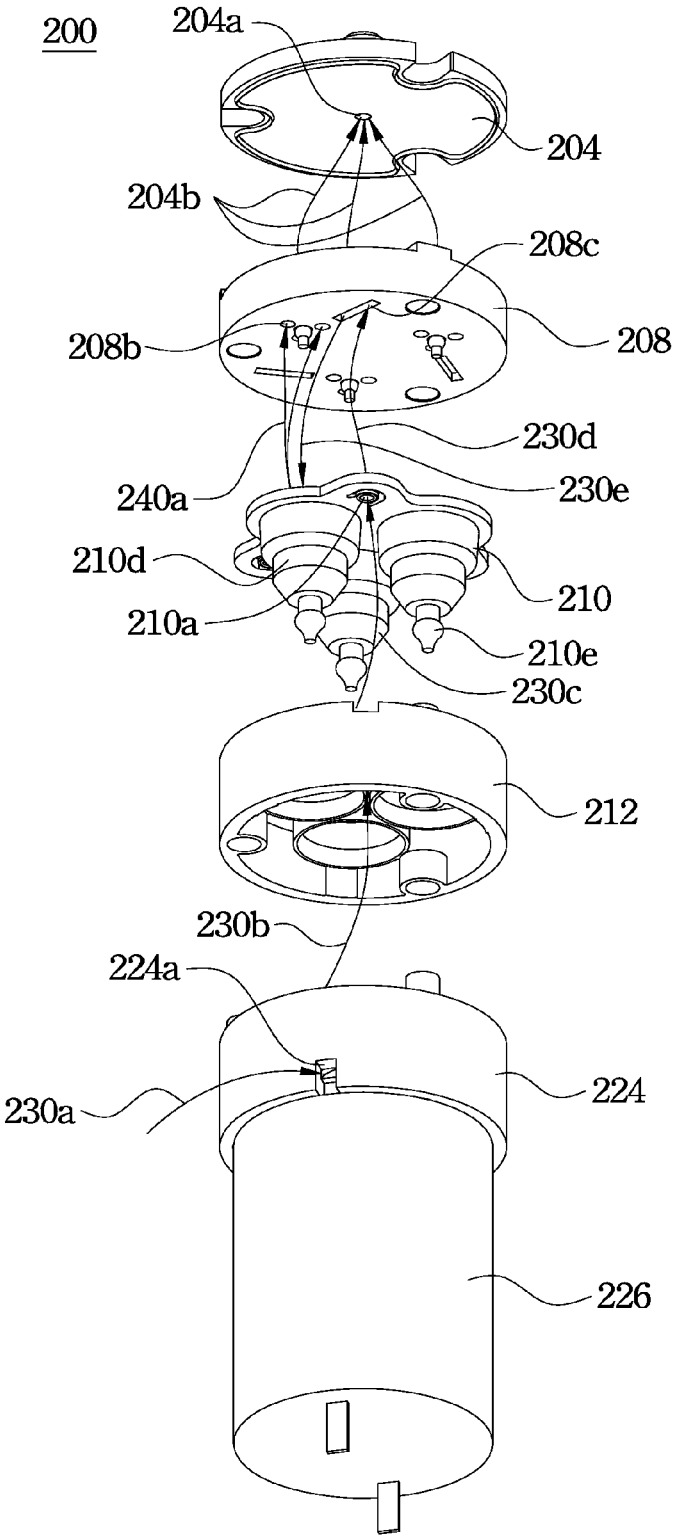
FIG. 3 illustrates an exploded view of a miniature pump according to a first embodiment of this invention (in a bottom view)

FIG. 3 illustrates an exploded view of a miniature pump according to a first embodiment of this invention (in a bottom view). The miniature pump is able to provide airflows after it introduces airflows into itself. When the miniature pump 200 tends to introduce airflows into itself, the bladder 210*d* is decompressed to direct airflows through the air inlet 224*a* in the direction 230*a*, through the bladder supporter 212 in the direction 230*b*, through the intake valve 210*a* in the direction 230*c*, through the concave passage 208*c* in the direction 230*d*, and finally introduced into the bladder 210*d* in the direction 230*e*. When the miniature pump 200 tends to output airflows, the bladder 210*d* is compressed to direct airflows through the output through hole 208*b* of the valve base 208 in the direction 240*a* and finally output through a central air outlet 204*a* in the direction 204*b*.

Figure 4:
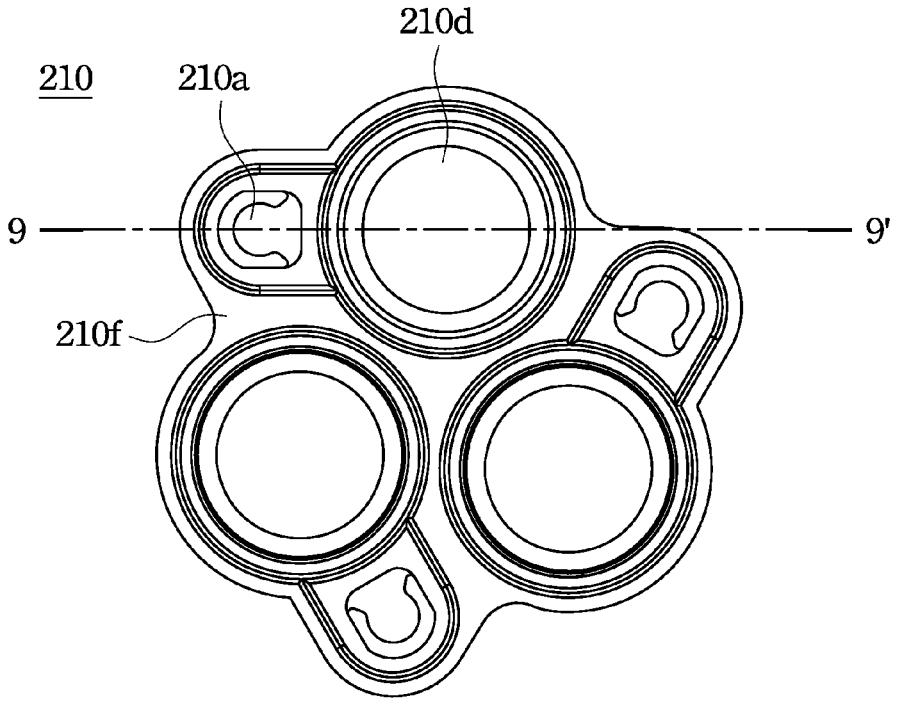
FIG. 4 illustrates an enlarged top view of the compression unit in FIG. 2.
Figure 5:
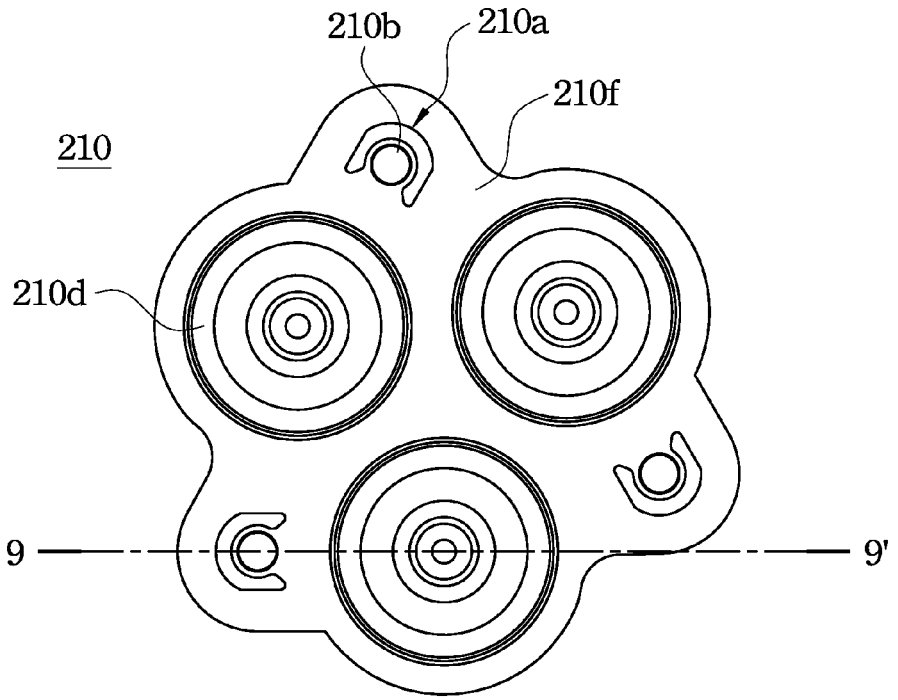
FIG. 5 illustrates an enlarged bottom view of the compression unit in FIG. 3.

FIG. 4 illustrates an enlarged top view of the compression unit in FIG. 2, and FIG. 5 illustrates an enlarged bottom view of the compression unit in FIG. 3. The compression unit 210 basically includes a flat plate section 210*f* and multiple bladders 210*d*. The flat plate section 210*f* is equipped with multiple intake valves 210*a*, and each intake valve 210*a* is used to cover a corresponding intake through hole 212*b* of the bladder supporter 212 (referring to FIG. 8A). Each intake valve 210*a* has a circular wall 210*b* to surround a corresponding intake through hole 212*b* (referring to FIG. 8A). The circular wall 210*b* of the intake valve 210*a* is to replace the convex block 102*a* as illustrated in FIG. 1. The intake valve 210*a* is made from rubber and easily manufactured, and has a prolonged usage life. The circular wall 210*b* of the intake valve 210*a* may be designed on the valve made of rubber or similar materials.

Figure 6:
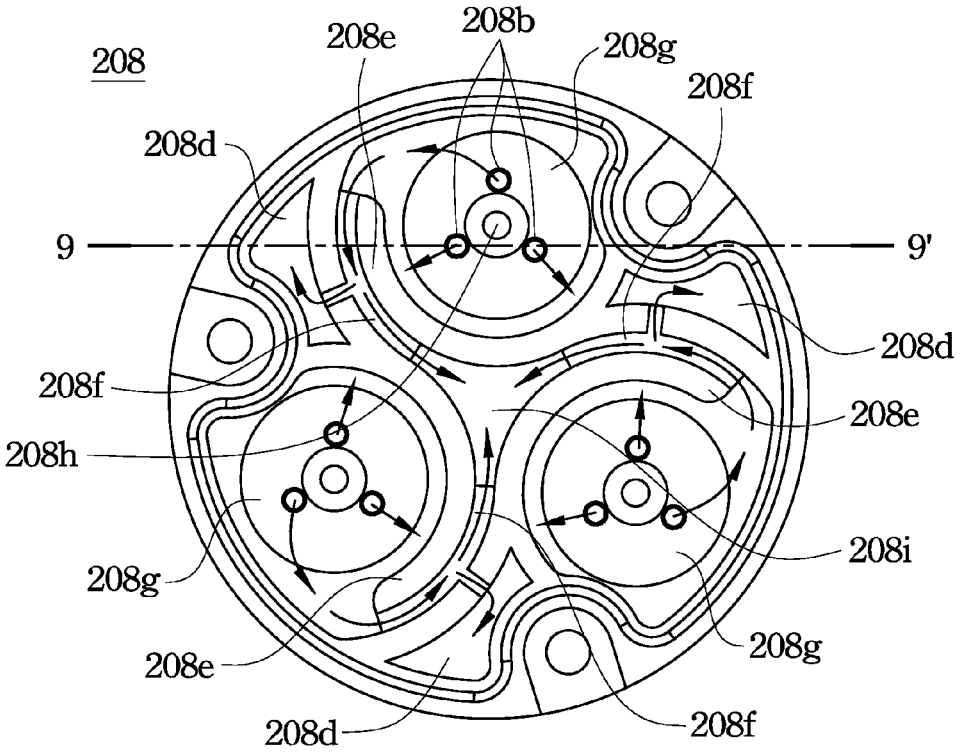
FIG. 6 illustrates an enlarged top view of the valve base in FIG. 2.
Figure 7:
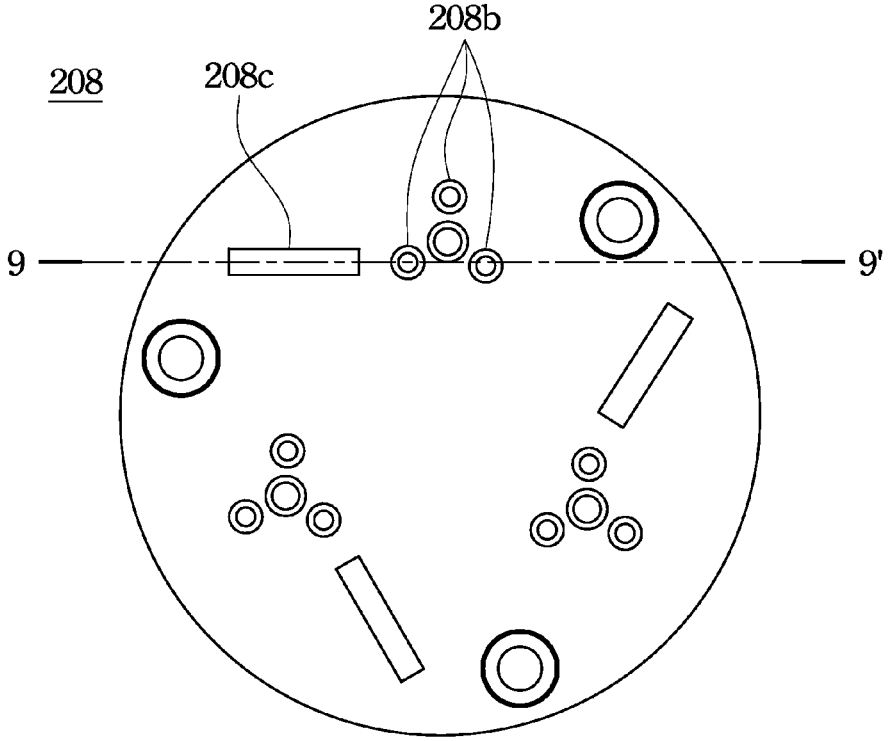
FIG. 7 illustrates an enlarged bottom view of the valve base in FIG. 3.

FIG. 6 illustrates an enlarged top view of the valve base in FIG. 2, and FIG. 7 illustrates an enlarged bottom view of the valve base in FIG. 3. The valve base 208 includes multiple bladder sections 208*g*, which are aligned with the bladders 210*d* of the compression unit 210 respectively. Each bladder section 208*g* has one or multiple output through hole 208*b* and an assembly hole 208*h*. The assembly hole 208*h* is used to assemble the output valve 206 (referring to FIG. 2). In addition, each bladder section 208*g* has an isolation wall 208*e* surrounding thereof, and any adjacent two isolation wall 208*e* define an air channel 208*f* therebetween. The valve base 208 includes at least one air chamber 208*d* on a top surface thereof, and each air chamber 208*d* is connected with a corresponding air channel 208*e*. All those air channels 208*e* are connected to a central area 208*i* of the valve base 208. When the top cover 204 covers the valve base 208, the central area 208*i* of the valve base 208 is aligned with the central air outlet 204*a* of the top cover 204 (referring to FIG. 3). The valve base 208 has a concave passage 208*c* on a bottom surface thereof (referring to FIG. 7). When the valve base 208 is mounted over the compression unit 210, the concave passage 208*c* is interconnected between the paired intake valve 210*a* and bladder 210*d* (referring to FIG. 3). The valve base 208 is designed with the air chambers 208*d* and air channels 208*e* to maintain stable airflows and reduce noises generated by unstable airflows.

Figure 8A:
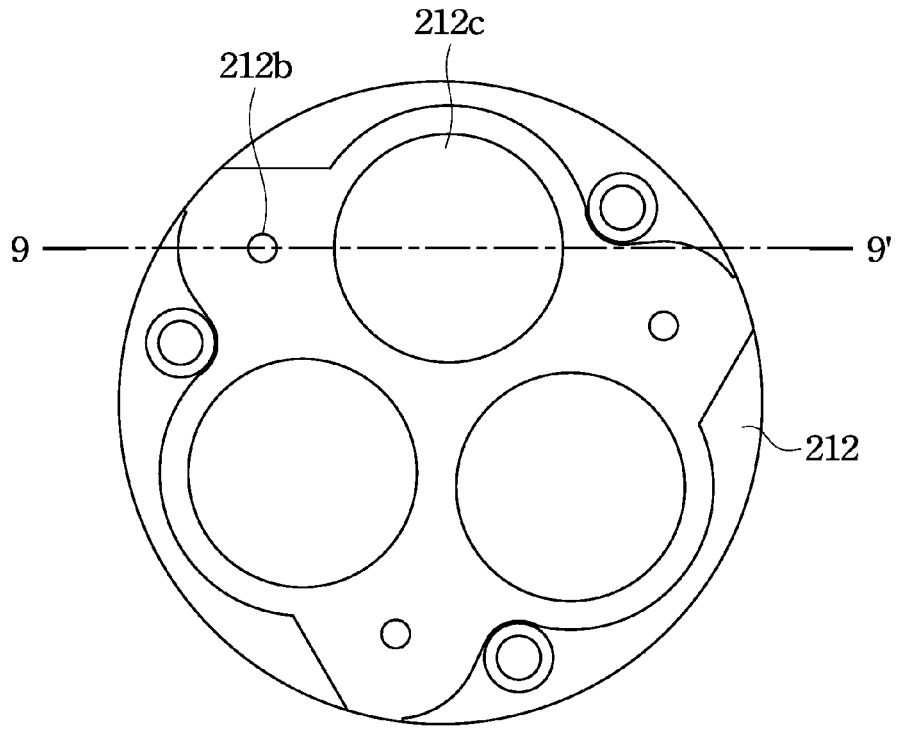
FIG. 8A illustrates an enlarged bottom view of the bladder supporter in FIG. 3.

FIG. 8A illustrates an enlarged bottom view of the bladder supporter in FIG. 3. The bladder supporter 212 is equipped with multiple receiving bores 212*c* allowing the multiple bladders 210*d* of the compression unit 210 to be accommodated within respectively (referring also to FIG. 3). When the compression unit 210 and the bladder supporter 212 are assembled, each intake valve 210*a* is mounted over a corresponding intake through hole 212*b*, and the circular wall 210*b* surrounds a corresponding intake through hole 212*b* (referring also to FIG. 9A).

Figure 8B:
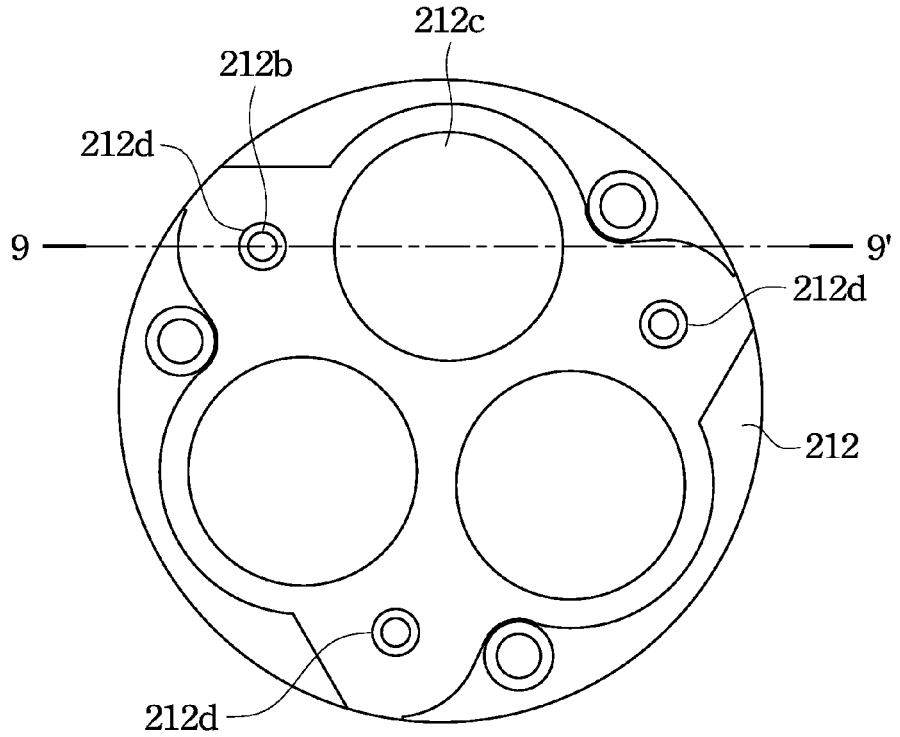
FIG. 8B illustrates an enlarged bottom view of the bladder supporter according to a second embodiment of this invention.
Figure 9A:
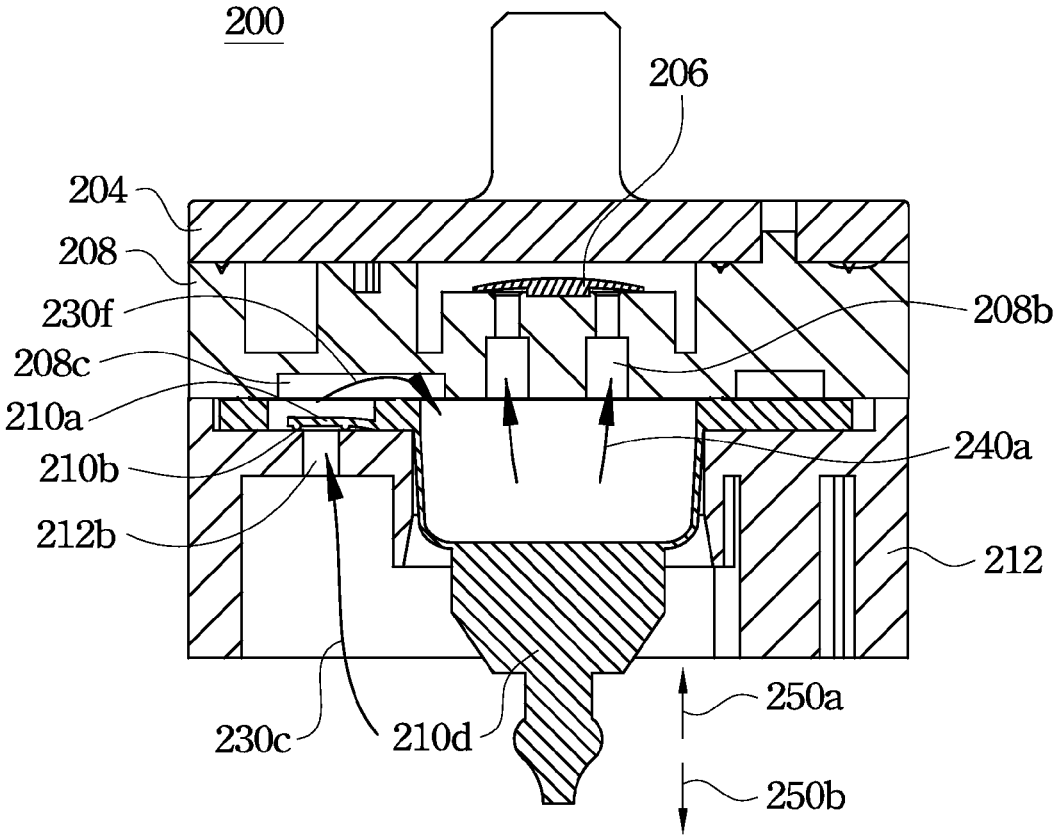
FIG. 9A illustrates a cross-sectional view along the line 9-9' of the miniature pump assembled by the components in FIGS. 4-8.

FIG. 9A illustrates a cross-sectional view along the line 9-9' of the miniature pump assembled by the components in FIGS. 4-8. When the miniature pump 200 tends to introduce airflows into itself, the bladder 210*d* is being decompressed, e.g., in the direction 250*b*, to direct airflows through the intake through hole 212*b* and the intake valve 210*a* in the direction 230*c*, through the concave passage 208*c* in the direction 230*f* and finally introduced into the bladder 210*d*. When the miniature pump 200 tends to output airflows, the bladder 210*d* is being compressed, e.g., in the direction 250*a*, to direct airflows through the output through hole 208*b* and the output valve 206 in the direction 240*a* to be output. The circular wall 210*b* of the intake valve 210*a* is to replace the conventional convex block 102*a* as illustrated in FIG. 1. The intake valve 210*a* is made from rubber and easily manufactured, and has a prolonged usage life.

Figure 9B:
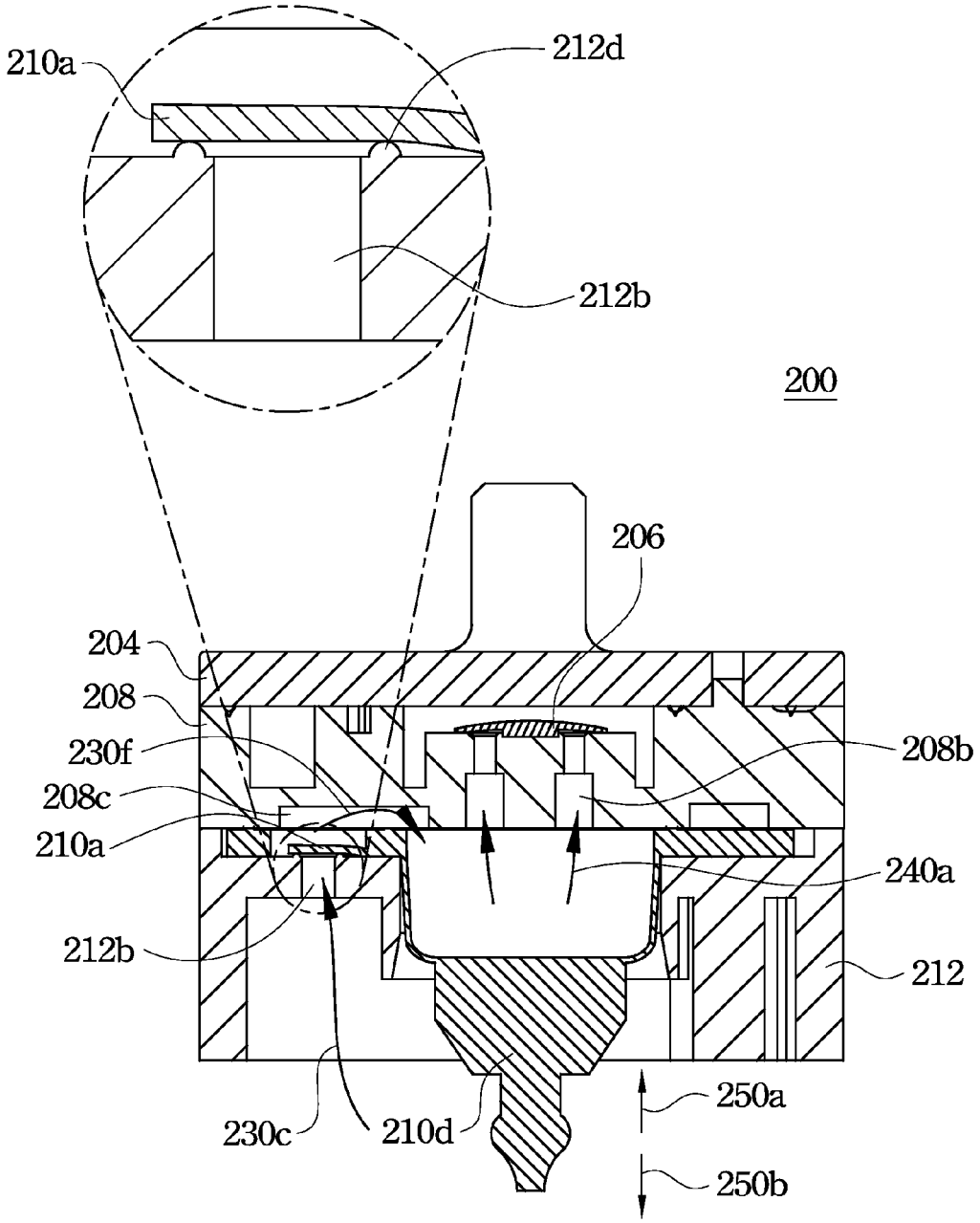
FIG. 9B illustrates a cross-sectional view of an assembled miniature pump according to the second embodiment of this invention.

FIG. 8B illustrates an enlarged bottom view of the bladder supporter according to a second embodiment of this invention, and FIG. 9B illustrates a cross-sectional view of an assembled miniature pump according to the second embodiment of this invention. The embodiment of FIGS. 8B and 9B is different from the embodiment of FIGS. 8A and 9A in the design of the circular wall. A circular wall 212*d* is designed on a top surface of the bladder supporter 212 instead of a bottom surface of the intake valve 210*a*. The circular wall 212*d* of the bladder supporter 212 basically serves the same function as the circular wall 210*b* of the intake valve 210*a* does.

Figure 10:
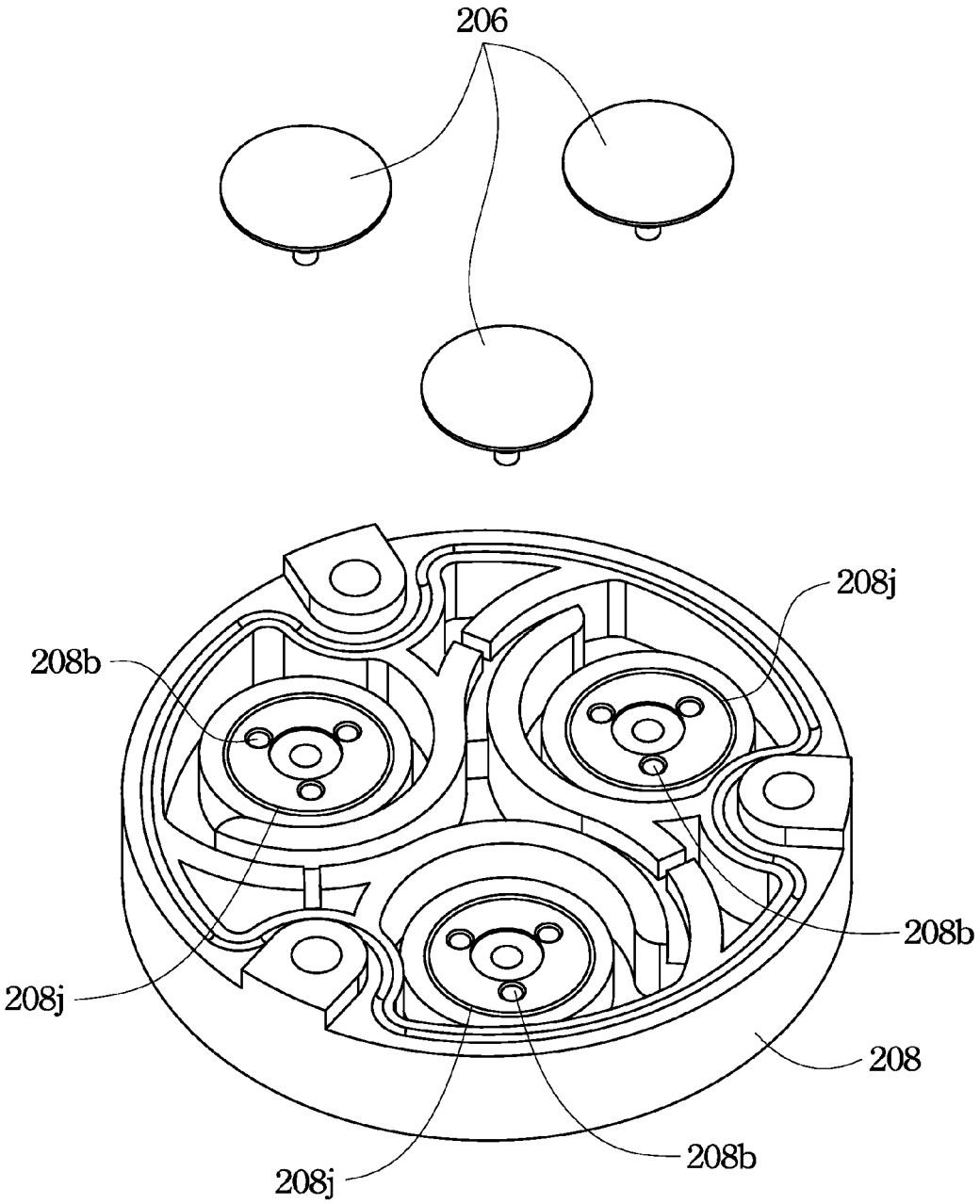
FIG. 10 illustrates a perspective view of a valve base and an output valve according to a third embodiment of this invention.
Figure 11:
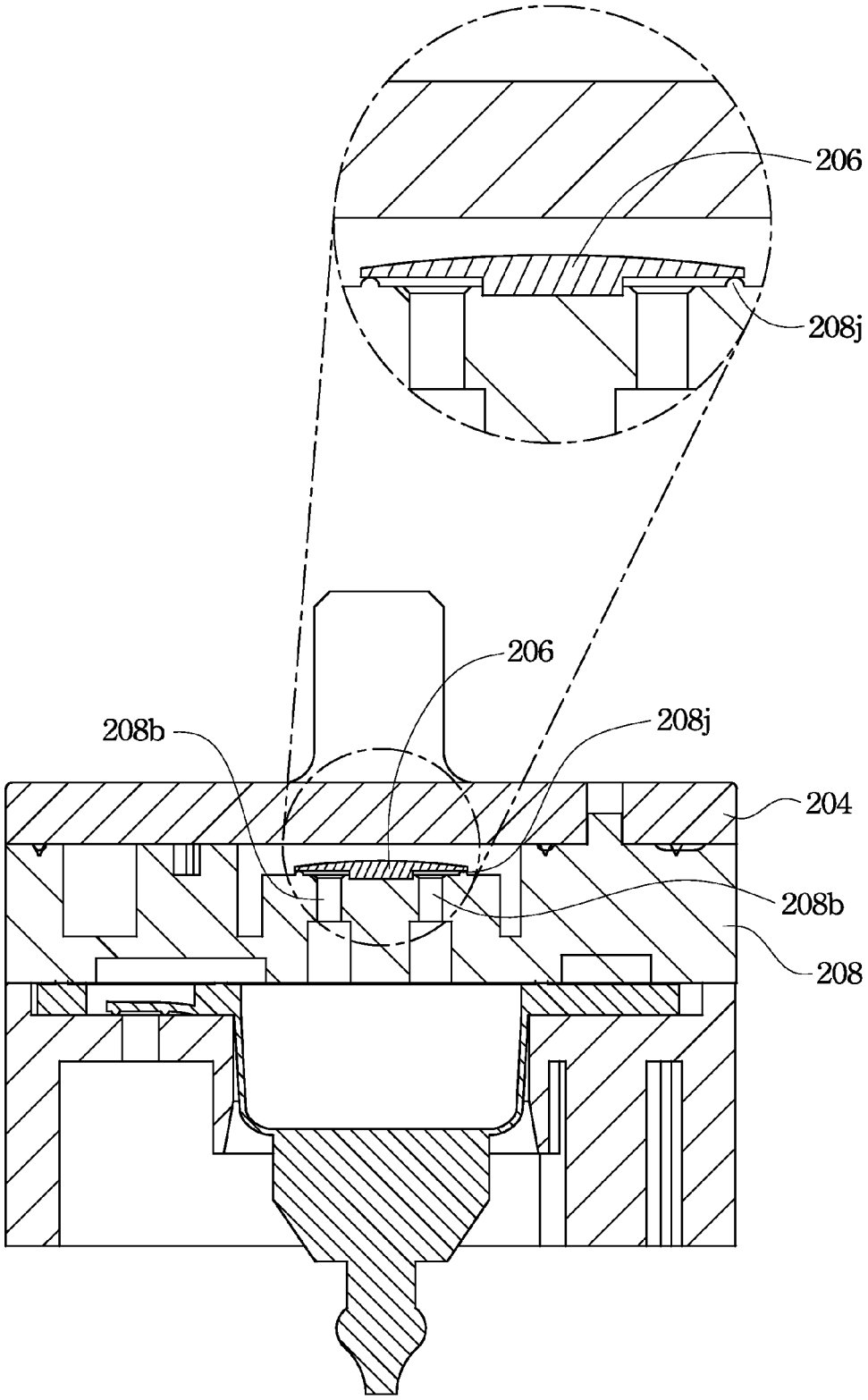
FIG. 11 illustrates a cross-sectional view of an assembled miniature pump according to the third embodiment of this invention.

FIG. 10 illustrates a perspective view of a valve base and an output valve according to a third embodiment of this invention, and FIG. 11 illustrates a cross-sectional view of an assembled miniature pump according to the third embodiment of this invention. The embodiment of FIGS. 10 and 11 is different from the previous embodiments in an additional circular wall 208*j* designed on a top surface of the valve base 208. The circular wall 208*j* is surrounded along a complete rim of each bladder section 208*g*, which surrounds the output through holes 208*b* and is covered by a corresponding output valve 206. The circular wall 208*j* provides an effective air seal and a decreased contact area between the output valve 206 and each bladder section 208*g*, thereby reducing noises generated by the output valve 206 patting each bladder section 208*g*.

Figure 12:
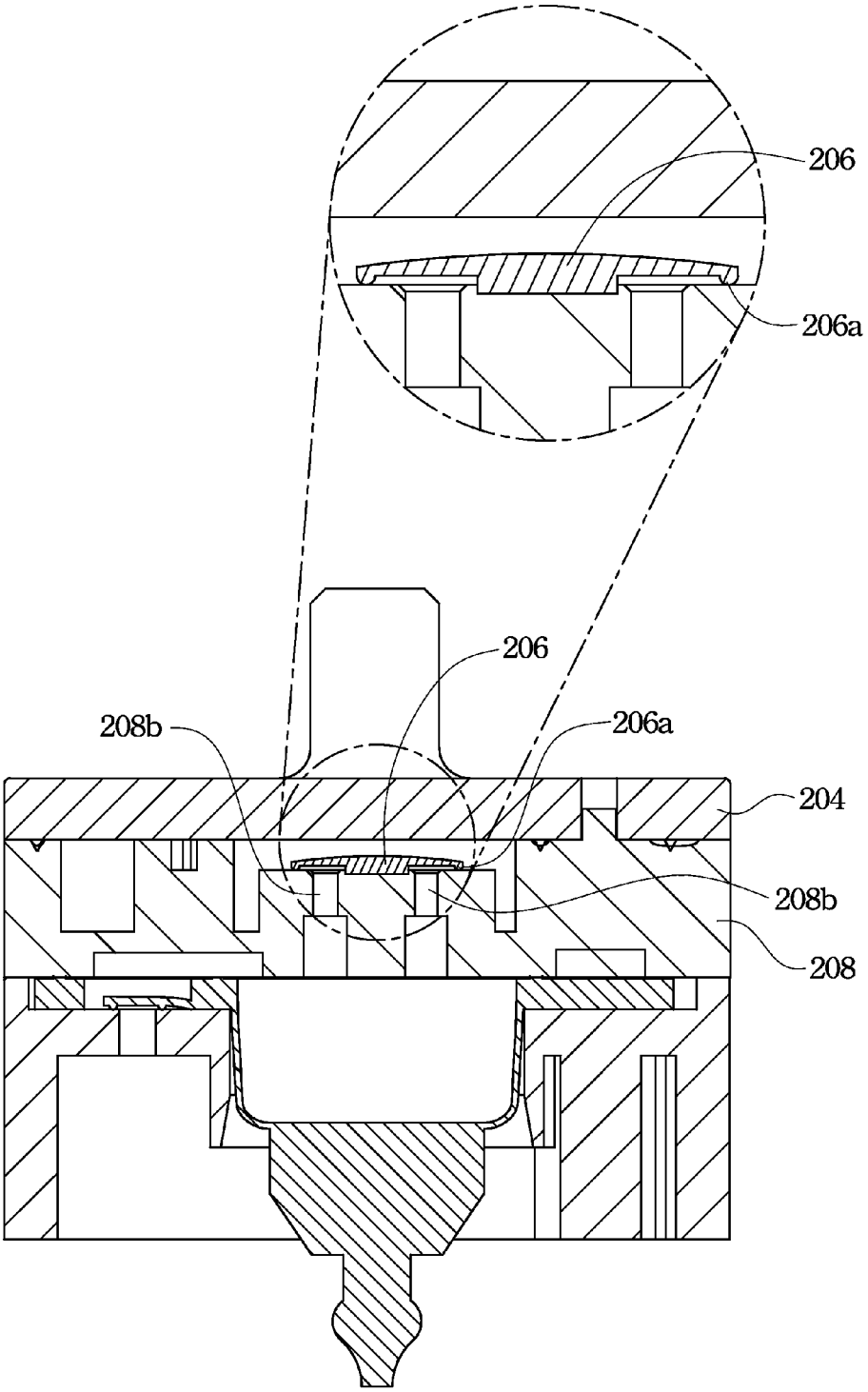
FIG. 12 illustrates a cross-sectional view of an assembled miniature pump according to a fourth embodiment of this invention.

FIG. 12 illustrates a cross-sectional view of an assembled miniature pump according to a fourth embodiment of this invention. The embodiment of FIG. 12 is different from the embodiment of FIGS. 10 and 11 in the design of the circular wall. A circular wall 206*a* is designed on a bottom surface of the output valve 206 instead of a top surface of the valve base 208. The circular wall 206*a* of the output valve 206 basically serves the same function as the circular wall 208*j* of the valve base 208 does.

According to the above-discussed embodiments, the miniature pump disclosed herein is equipped with at least the following advantages: (1) the circular wall surrounding the intake through hole has airflow control function, and the intake valve is made from rubber and easily manufactured, and has a prolonged usage life; (2) the circular wall surrounding the output through hole provides an effective air seal and a decreased contact area, thereby reducing noises; (3) the top surface of the valve base is designed with air chambers and air channels to maintain stable airflows from the output through hole to the central air outlet, thereby reducing noises generated from unstable airflows.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A miniature pump comprising:

a driving unit; and an airflow control unit driven by the driving unit to force fluid to be input or output through the airflow control unit, wherein the airflow control unit comprises:

a bladder supporter having a plurality of intake through holes;

a compression unit having a plurality of intake valves and a plurality of bladders, each intake valve covering the corresponding intake through hole, each intake through hole is surrounded by a circular wall, wherein the circular wall is in contact with a bottom surface of the corresponding intake valve, the circular wall occupying an area of the bottom surface of the corresponding intake valve, which is smaller than a total area of the bottom surface of the corresponding intake valve;

a valve base disposed over the compression unit, the valve base having a plurality of output through holes aligned with the bladders respectively; and an output valve covering the output through holes, wherein the valve base has a plurality of bladder sections aligned with the bladders respectively, each bladder section has an isolation wall around thereof, and any adjacent two of the isolation walls define an air channel therebetween, the valve base further comprises at least one air chamber, and each air chamber is connected with a corresponding one of the air channel, a top cover disposed over the valve base, the top cover having a central air outlet, all the air channels are connected to a central area of the valve base, which is aligned with the central air outlet, when the bladder is compressed, air inside the bladder is output via the output through hole and the output valve, when the bladder is decompressed, external air is introduced into the bladder via the intake through hole and the intake valve.

2. The miniature pump of claim 1, wherein the bladder supporter has a plurality of receiving bores, each receiving bore accommodates the corresponding bladder.

3. The miniature pump of claim 1, wherein the valve base has a concave passage on a bottom surface of the valve base, the concave passage is interconnected between the intake valve and the bladder.

4. The miniature pump of claim 1, wherein the driving unit comprises a motor and a compression vane, the compression vane is coupled with a rotation rod of the motor.

5. The miniature pump of claim 4, wherein the compression vane has a plurality of connection slots, each connection slot is fastened to a bottom end of the bladder.

6. The miniature pump of claim 1, wherein the compression unit comprises a flat plate section on which the intake valves are located.

7. A miniature pump comprising:

a driving unit; and an airflow control unit driven by the driving unit to force fluid to be input or output through the airflow control unit, wherein the airflow control unit comprises:

a bladder supporter having a plurality of intake through holes;

a compression unit having a plurality of intake valves and a plurality of bladders, each intake valve covering the corresponding intake through hole;

a valve base disposed over the compression unit, the valve base having a plurality of output through holes aligned with the bladders respectively; and an output valve covering the output through holes, each output through hole is surrounded by a circular wall, wherein the circular wall is in contact with a bottom surface of the output valve, the circular wall occupying an area of the bottom surface of the output valve, which is smaller than a total area of the bottom surface of the output valve, wherein the valve base has a plurality of bladder sections aligned with the bladders respectively, each bladder section has an isolation wall around thereof, and any adjacent two isolation walls define an air channel therebetween, the valve base further comprises at least one air chamber, and each air chamber is connected with a corresponding one of the air channel, a top cover disposed over the valve base, the top cover having a central air outlet, all the air channels are connected to a central area of the valve base, which is aligned with the central air outlet, when the bladder is compressed, air inside the bladder is output via the output through hole and the output valve, when the bladder is decompressed, external air is introduced into the bladder via the intake through hole and the intake valve.

8. The miniature pump of claim 7, wherein the valve base has a plurality of bladder sections aligned with the bladders respectively, the circular wall is surrounded along a complete rim of each bladder section.

9. The miniature pump of claim 7, wherein the bladder supporter has a plurality of receiving bores, each receiving bore accommodates the corresponding bladder.

10. The miniature pump of claim 7, wherein the valve base has a concave passage on a bottom surface of the valve base, the concave passage is interconnected between the intake valve and the bladder.

11. The miniature pump of claim 7, wherein the driving unit comprises a motor and a compression vane, the compression vane is coupled with a rotation rod of the motor.

12. The miniature pump of claim 11, wherein the compression vane comprises a plurality of connection slots, each connection slot is fastened to a bottom end of the bladder.

13. The miniature pump of claim 7, wherein the compression unit comprises a flat plate section on which the intake valves are located.

* * * * *